US008378931B2

(12) United States Patent
Kim et al.

(10) Patent No.: US 8,378,931 B2
(45) Date of Patent: Feb. 19, 2013

(54) PIXEL AND ORGANIC LIGHT EMITTING DISPLAY DEVICE

(75) Inventors: Dong-Hwi Kim, Suwon-si (KR); Yang-Wan Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 593 days.

(21) Appl. No.: 12/371,326

(22) Filed: Feb. 13, 2009

(65) Prior Publication Data

US 2009/0251392 A1 Oct. 8, 2009

(30) Foreign Application Priority Data

Apr. 3, 2008 (KR) ..... 10-2008-0031089

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS

| | | | | |
|---|---|---|---|---|
| 7,692,619 | B2 * | 4/2010 | Shin | 345/100 |
| 7,714,810 | B2 * | 5/2010 | Kasai et al. | 345/76 |
| 2008/0036704 | A1 * | 2/2008 | Kim et al. | 345/76 |

FOREIGN PATENT DOCUMENTS

| | | | |
|---|---|---|---|
| JP | 10-319908 | | 12/1998 |
| JP | 2000-163015 | | 6/2000 |
| JP | 2001-147665 | | 5/2001 |
| JP | 2004-29791 | | 1/2004 |
| JP | 2008-40451 | | 2/2008 |
| KR | 1020060056785 | A | 5/2006 |
| KR | 1020060073689 | A | 6/2006 |
| KR | 10-2007-0025151 | | 3/2007 |
| KR | 10200739335 | B1 | 7/2007 |
| KR | 1020070120347 | A | 12/2007 |

OTHER PUBLICATIONS

JPO Office Action dated Aug. 9, 2011, for corresponding JP Patent Application No. 2008-162808, 2 pages.

* cited by examiner

*Primary Examiner* — Daniell L Negron
(74) *Attorney, Agent, or Firm* — Christie, Parker & Hale, LLP

(57) ABSTRACT

A pixel and an organic light emitting display device using the same is provided. The pixel includes an organic light emitting diode (OLED). A pixel circuit controls an amount of current that flows into the OLED. In the pixel, the pixel circuit includes a first transistor controlling an amount of current that flows into a second power source via the OLED from a first power source. A storage capacitor is positioned between a gate electrode of the first transistor and the second power source. A boosting capacitor is positioned between the gate electrode of the first transistor and a boost line.

15 Claims, 3 Drawing Sheets

PIXEL AND ORGANIC LIGHT EMITTING DISPLAY DEVICE

CROSS-REFERENCE TO RELATED APPLICATION

This application claims priority to and the benefit of Korean Patent Application No. 10-2008-0031089, filed on Apr. 3, 2008, in the Korean Intellectual Property Office, the entire content of which is incorporated herein by reference.

BACKGROUND OF THE INVENTION

1. Field of the Invention

The present invention relates to a pixel and an organic light emitting display device using the same, and more particularly, to a pixel and an organic light emitting display device using the same that can save manufacturing costs and stably express a black gray level.

2. Description of Related Art

Recently, there have been various types of flat panel display devices capable of reducing their weight and volume, which are unfavorable in cathode ray tubes. The flat panel display devices include, for example, liquid crystal displays, field emission displays, plasma display panels and organic light emitting display devices.

Among these flat panel display devices, the organic light emitting display device displays images using an organic light emitting diode (OLED) that emits light through the recombination of electrons and holes. The organic light emitting display device has a fast response speed and is driven with low power consumption. Typically, in an organic light emitting display device a current corresponding to a data signal is supplied to an OLED using a driving transistor formed for each pixel, so that light is emitted from the OLED.

To this end, each of the pixels includes a storage capacitor to be charged with a voltage corresponding to a data signal supplied to a data line. The storage capacitor in turn supplies the charged voltage to a driving transistor. Therefore, in order to display an image with a desired gray level, the voltage corresponding to the data signal needs to be precisely charged in the storage capacitor.

However, in a conventional organic light emitting display device, a desired voltage may not be precisely charged in the storage capacitor. More specifically, a data signal is supplied to a storage capacitor by means of a data line. Here, a parasitic capacitor exists in the data line, and therefore, the data signal supplied to the data line is supplied to the storage capacitor while charging the parasitic capacitor. In this case, a voltage corresponding to a desired data signal is not charged in the storage capacitor due to charge sharing of the parasitic capacitor and the storage capacitor. Particularly, in the event that black is expressed in the organic light emitting display device, a gray scale is expressed, and display quality is degraded.

SUMMARY OF THE INVENTION

In accordance with the present invention a pixel and an OLED device using the same is provided that can save manufacturing costs and stably express a black gray level.

In accordance with the present invention a pixel includes an organic light emitting diode (OLED). A pixel circuit controls an amount of current that flows into the OLED. The pixel circuit includes a first transistor controlling an amount of current that flows into a second power source via the OLED from a first power source. A storage capacitor is positioned between a gate electrode of the first transistor and the second power source. A boosting capacitor is positioned between the gate electrode of the first transistor and a boost line.

In an exemplary embodiment the pixel circuit includes a second transistor coupled to a data line and an i-th scan line (i is a natural number), the second transistor being turned on to supply a data signal supplied from the data line to a first electrode of the first transistor when a scan signal is supplied to the i-th scan line. A third transistor is coupled between the gate electrode of the first transistor and a second electrode of the first transistor, the third transistor being turned on when the scan signal is supplied to the i-th scan line. A fourth transistor is coupled between the first power source and the first electrode of the first transistor, the fourth transistor being turned on or off in response to a light emitting control signal supplied to a light emitting control line. A fifth transistor is coupled between the second electrode of the first transistor and the OLED, the fifth transistor turned on or off in response to a light emitting control signal supplied to the light emitting control line.

According to another embodiment of the present invention, an organic light emitting display device is provided. A scan driver sequentially supplies a scan signal to scan lines and sequentially supplies a light emitting control signal to light emitting control lines. A boost driver sequentially supplyies a boost signal to boost lines. A data driver supplyies a data signal to data lines. Pixels emit light with a predetermined luminance in response to the data signal. Each of the pixels positioned in i-th horizontal line (i is a natural number) includes an OLED. A first transistor controls an amount of current that flows into a second power source via the OLED from a first power source. A storage capacitor is positioned between a gate electrode of the first transistor and the second power source. A boosting capacitor is positioned between the gate electrode of the first transistor and an i-th boost line.

Each of the pixels may include a second transistor coupled to a data line and an i-th scan line, the second transistor being turned on to supply a data signal supplied from the data line to a first electrode of the first transistor when a scan signal is supplied to the i-th scan line. A third transistor may be coupled between the gate electrode of the first transistor and a second electrode of the first transistor, the third transistor being turned on when the scan signal is supplied to the i-th scan line. A fourth transistor may be coupled between the first power source and the first electrode of the first transistor, the fourth transistor being turned on or off in response to a light emitting control signal supplied to an i-th light emitting control line. A fifth transistor may be coupled between the second electrode of the first transistor and the OLED, the fifth transistor being turned on or off in response to the light emitting control signal supplied to the i-th light emitting control line. One side of the storage capacitor and one side of the boosting capacitor may be formed of polysilicon (poly).

In a pixel and an organic light emitting display device using the same according to the present invention, since the voltage of a gate electrode of a driving transistor is raised using a boosting capacitor, an image with a desired gray level can be displayed. Further, in accordance with the present invention, since a storage capacitor and a boosting capacitor are formed as MOS capacitors, manufacturing costs can be saved.

DETAILED DESCRIPTION

Figure 1:
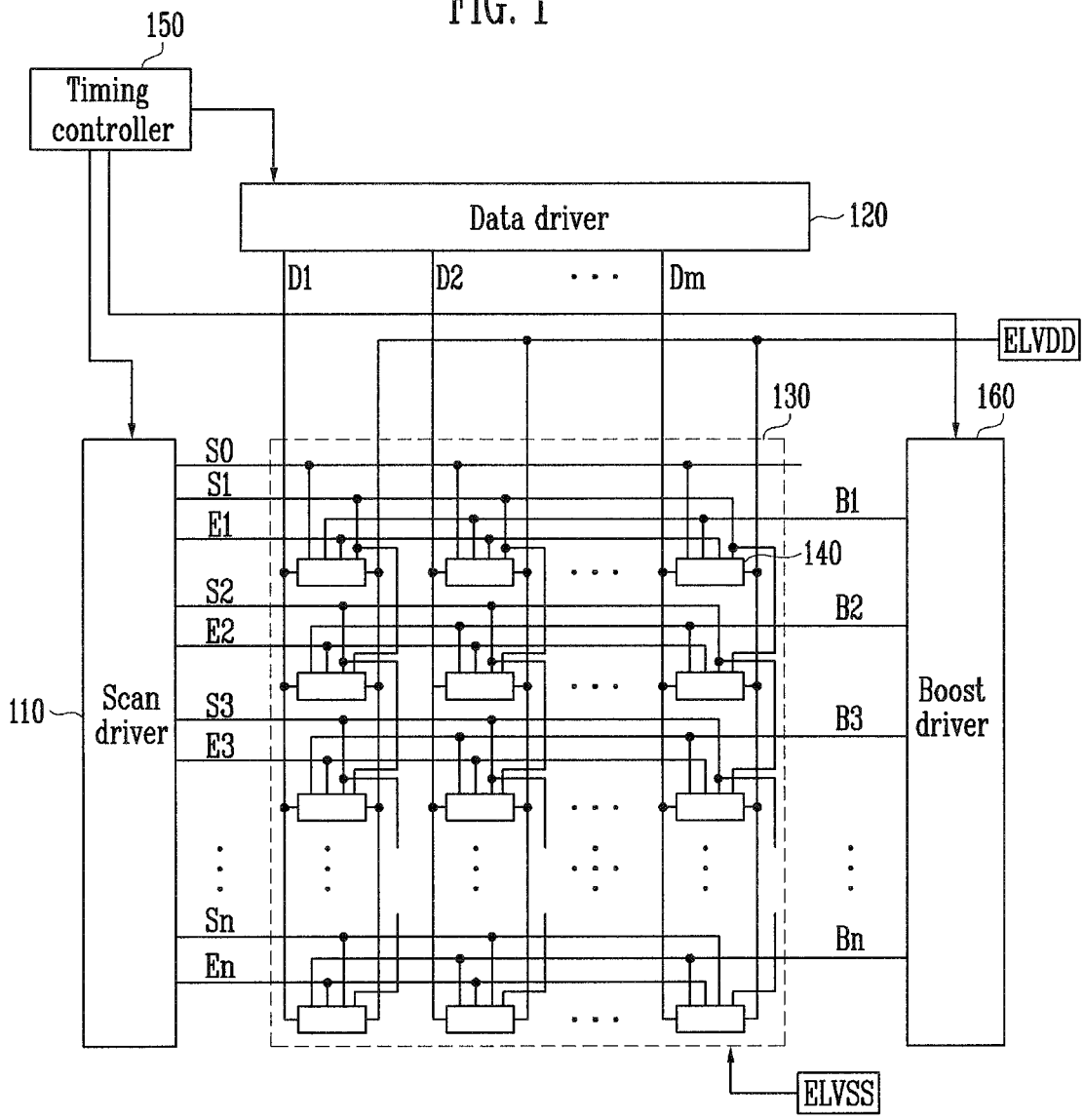
FIG. 1 is a schematic block diagram of an organic light emitting display device according to an embodiment of the present invention.

Hereinafter, when a first element is described as being coupled to a second element, the first element may not only be directly coupled to the second element but may also be indirectly coupled to the second element via a third element. Further, some of the elements that are not essential to the complete understanding of the invention are omitted for clarity. Also, like reference numerals refer to like elements throughout.

Referring to FIG. 1, the organic light emitting display device according to the embodiment of the present invention includes a scan driver 110, a data driver 120, a pixel unit 130, a timing controller 150, and a boost driver 160.

The pixel unit 130 includes a plurality of pixels 140 positioned at regions defined by scan lines S1 to Sn, light emitting control lines E1 to En, boost lines B1 to Bn and data lines D1 to Dm. Each of the pixels 140 emits light with a predetermined luminance in response to a data signal supplied from a data line D.

To this end, each of the pixels 140 is coupled to two scan lines, one data line, one boost line, a power line supplying first power ELVDD and an initialization power line (not shown) supplying initialization power. For example, each of the pixels 140 positioned in the last horizontal line is coupled to a (n−1)-th scan line Sn−1, an n-th, a data line D, a boost line Bn, a power line and the initialization power line. In the present invention, a 0-th scan line S0 is additionally formed to be coupled to the pixels 140 positioned in the first horizontal line.

The scan driver 110 generates a scan signal in response to a control signal from the timing controller 150 and sequentially supplies the generated scan signal to the scan lines S0 to Sn. The scan driver 110 also generates a light emitting control signal and sequentially supplies the generated light emitting control signal to the light emitting control lines E1 to En. The light emitting control signal supplied to an i-th light emitting control line Ei (i is a natural number) is supplied to overlap with scan signals supplied to (i−1)-th and i-th scan lines Si−1 and Si.

The boost driver 160 generates a boost signal in response to a control signal from the timing controller 150 and sequentially supplies the generated boost signal to the boost lines B1 to Bn. The boost signal supplied to i-th boost line Bi is supplied slower than the light emitting control signal supplied to the i-th light emitting control line Ei, and the supply of the boost signal is suspended after the supply of the light emitting control signal has been suspended. The boost signal supplied to the i-th booster line Bi is simultaneously supplied with the scan signal supplied to the (i−1)-th scan line Si−1. The boost driver 160 may be provided inside the scan driver 110.

The data driver 120 generates data signals in response to a control signal from the timing controller 150 and supplies the generated data signals to the data lines D1 to Dm. The data signals supplied to the data lines D1 to Dm are supplied every horizontal period.

The timing controller 150 receives synchronization signals (not shown) supplied from the outside to control the scan driver 110, the data driver 120 and the boost driver 160. The timing controller 150 rearranges data (not shown) supplied from the outside to supply the rearranged data to the data driver 120.

Figure 2:
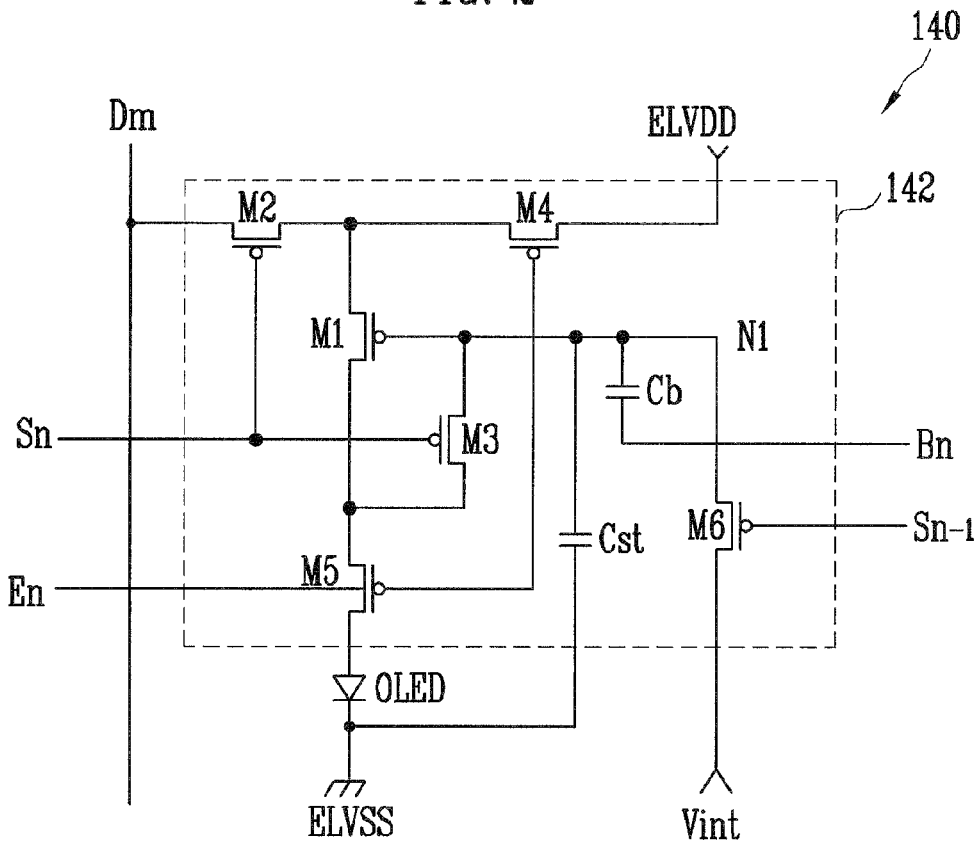
FIG. 2 is a circuit diagram illustrating an embodiment of a pixel shown in FIG. 1.

FIG. 2 is a circuit diagram illustrating an embodiment of a pixel shown in FIG. 1, in which a pixel coupled to an n-th boost line Bn and an m-th data line Dm is shown for convenience of illustration.

Referring to FIG. 2, the pixel 140 according to the embodiment of the present invention includes a pixel circuit 142 coupled to an organic light emitting diode (OLED), a data line Dm, scan lines Sn−1 and Sn, a boost line Bn, and a light emitting control line En to control the OLED.

An anode electrode of the OLED is coupled to the pixel circuit 142, and a cathode electrode of the OLED is coupled to a second power source ELVSS. The OLED emits light with a predetermined luminance corresponding to an amount of current supplied from the pixel circuit 142.

The pixel circuit 142 controls an amount of current that flows into the second power source ELVSS via the OLED from a first power source ELVDD. The voltage of the first power source ELVDD is set to be higher than that of the second power source ELVSS. To this end, the pixel circuit 142 includes transistors M1, M2, M3, M4, M5, M6, a storage capacitor Cst, and a boosting capacitor Cb.

A first electrode of the first transistor M1 (a PMOS transistor) is coupled to the first power source ELVDD via the fourth transistor M4, and a second electrode of the first transistor M1 is coupled to the OLED via the fifth transistor M5. A gate electrode of the first transistor M1 is coupled to a first node N1. The first transistor M1 supplies a voltage charged in the storage capacitor Cst, i.e., a current corresponding to a voltage applied to the first node N1, to the OLED.

When referring to first electrodes and second electrodes, the first electrode is set to be any one of drain and source electrodes, and the second electrode is set to be the other electrode. For example, if the first electrode is set to be a source electrode, the second electrode is set to be a drain electrode.

A first electrode of the third transistor M3 is coupled to the second electrode of the first transistor M1, and a second electrode of the third transistor M3 is coupled to the gate electrode of the first transistor M1. A gate electrode of the third transistor M3 is coupled to the n-th scan line Sn. When a scan signal is supplied to the n-th scan line Sn, the third transistor M3 is turned on to allow the first transistor M1 to be coupled in a diode form.

A first electrode of the second transistor M2 is coupled to the data line Dm, and a second electrode of the second transistor M2 is coupled to the first electrode of the first transistor M1. A gate electrode of the second transistor M2 is coupled to the n-th scan line Sn. When a scan signal is supplied to the n-th scan line Sn, the second transistor M2 is turned on to supply a data signal supplied to the data line Dm to the first electrode of the first transistor M1.

A first electrode of the fourth transistor M4 is coupled to the first power source ELVDD, and a second electrode of the fourth transistor M4 is coupled to the first transistor M1. A gate electrode of the fourth transistor M4 is connected to the light emitting control line En. When a light emitting control signal is not supplied (i.e., when a low voltage is applied), the fourth transistor M4 is turned on to allow the first transistor M1 to be electrically coupled to the first power source ELVDD.

A first electrode of the fifth transistor M5 is coupled to the second electrode of the first transistor M1, and a second electrode of the fifth transistor M5 is coupled to the OLED. A gate electrode of the fifth transistor M5 is coupled to the light emitting control line En. When a light emitting control signal is not supplied (i.e., when a low voltage is applied), the fifth transistor M5 is turned on to allow the first transistor M1 to be electrically coupled to the OLED.

A first electrode of the sixth transistor M6 is coupled to the storage capacitor Cst and the gate electrode of the first transistor M1 (i.e., at the first node N1), and a second electrode of the sixth transistor M6 is coupled to an initialization power source Vint. A gate electrode of the sixth transistor M6 is coupled to the (n−1)-th scan line Sn−1. When a scan signal is supplied to the (n−1)-th scan line Sn−1, the sixth transistor M6 is turned on to initialize the first node N1. To this end, the voltage of the initialization power source Vint is set to be a voltage lower than that of a data signal, e.g., a voltage of a negative polarity.

The storage capacitor Cst is coupled between the gate electrode of the first transistor M1 and the second power source ELVSS. A voltage corresponding to a data signal is charged in the storage capacitor Cst.

The boosting capacitor Cb is formed between the gate electrode of the first transistor M1 and the boost line Bn. After a voltage is charged in the storage capacitor Cst, the boosting capacitor Cb raises a voltage of the gate electrode of the first transistor M1. If the voltage of the gate electrode of the first transistor M1 rises after the voltage has been charged in the storage capacitor, a black gray scale (including other gray levels) can be precisely expressed.

Figure 3:
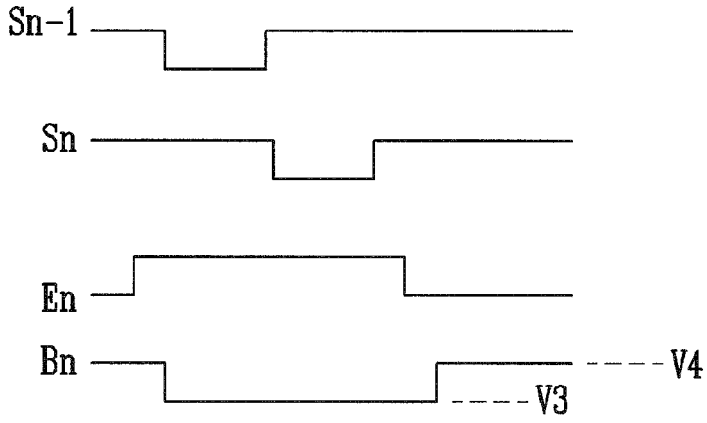
FIG. 3 is a waveform diagram illustrating a driving method of the pixel shown in FIG. 2.

FIG. 3 is a waveform diagram illustrating a driving method of the pixel shown in FIG. 2.

An operational process will now be described with reference to FIGS. 2 and 3. First of all, before a scan signal is supplied to the (n−1)-th scan line Sn−1, a light emitting control signal (a high voltage) is supplied to the n-th light emitting control line En, and thus the fourth and fifth transistors M4, M5 are turned off.

Thereafter, a scan signal is supplied to the (n−1)-th scan line Sn−1, and a boost signal (a low voltage) is simultaneously supplied to the n-th boost line Bn. If the scan signal is supplied to the (n−1)-th scan line Sn−1, the sixth transistor M6 is turned on. If the sixth transistor M6 is turned on, the first node N1 is coupled to the initialization power source Vint. Then, the first node N1 is initialized to the voltage of the initialization power source Vint.

If the boost signal is supplied to the n-th boost line, a third voltage V3 is supplied to a first terminal of the boosting capacitor Cb.

After the first node N1 is initialized to the voltage of the initialization power source Vint, as scan signal is supplied to the n-th scan line Sn. If the scan signal is supplied to the n-th scan line Sn, the second and third transistors M2, M3 are turned on.

If the second transistor M2 is turned on, a data signal supplied to the data line Dm is supplied to the first electrode of the first transistor M1. If the third transistor M3 is turned on, the first transistor M1 is coupled in a diode form. Since the voltage of the first node N1 is initialized to the voltage of the initialization power source Vint (i.e., the voltage of the first node N1 is set to be lower than that of the data signal), the first transistor M1 is turned on. If the first transistor M1 is turned on, the data signal is supplied to the first node N1 via the first and third transistors M1, M3. At this time, a voltage corresponding to the data signal and the threshold voltage of the first transistor M1 is charged in the storage capacitor Cst.

The voltage of the data signal is set to be lower than a desired voltage due to the charge sharing of a parasitic capacitor and the storage capacitor Cst on the data line Dm. Therefore, the desired voltage is not charged in the storage capacitor Cst.

After a predetermined voltage is charged in the storage capacitor Cst, the supply of the scan signal to the n-th scan line Sn and the supply of the light emitting control signal to the n-th light emitting control line En are suspended. After the supply of the light emitting control signal to the n-th light emitting control line En is suspended, the supply of the boost signal to the n-th boost line Bn is suspended.

If the supply of the boost signal to the n-th boost line Bn is suspended, the voltage of the n-th boost line Bn rises from the third voltage V3 to a fourth voltage V4. If the voltage of the n-th boost line Bn rises, the voltage of the first node N1 is also raised by the boosting capacitor Cb. If the voltage of the first node N1 is raised by the boosting capacitor Cb, an image with a desired luminance can be displayed. To this end, the third and fourth voltages V3, V4 are set to compensate for the voltage of the data signal lost due to the charge sharing. For example, the third voltage V3 may be set to be the voltage of the second power source ELVSS, and the fourth voltage V4 may be set to be the voltage of the initialization power source Vint.

As described above, in the present invention, the voltage of the gate electrode of the first transistor M1 is raised using the boosting capacitor Cb formed between the boost line Bn and the gate electrode of the first transistor M1. In this case, the voltage loss of the data signal due to the charge sharing between the parasitic capacitor and the storage capacitor Cst on the data line Dm can be compensated. Accordingly, an image with a desired luminance can be displayed.

In accordance with the present invention, the storage capacitor Cst is formed between the second power source ELVSS and the first node N1. As such, if the storage capacitor Cst is positioned between the second power source ELVSS and the first node N1, the number of masks used for forming the storage capacitor Cst can be decreased.

More specifically, a storage capacitor Cst is metal-treated by crystallizing poly, and a voltage is stored using the overlapping area between the metal-treated poly and a gate metal (metal cap) (the overlapping area between a gate metal and a source/drain metal may be additionally used to increase capacity). However, a mask is added in a treating process, and therefore manufacturing costs may be increased.

Thus, the storage capacitor Cst of the present invention is formed using the overlapping area of poly and a gate metal (MOS cap) (the overlapping area between a gate metal and a source/drain metal may be additionally used to increase capacity). In this case, a mask used for crystallizing poly is removed, and therefore manufacturing costs can be saved.

When one side of the storage capacitor Cst is set to be poly, the voltage between both sides of the storage capacitor Cst should be driven at −4V or less (e.g., ELVSS (the voltage of a data signal) should be set to be −4V or less) so that a MOS capacitor is normally operated.

In the present invention, since the storage capacitor Cst is positioned between the second power source ELVSS and the first node N1, a voltage can be stably charged in a MOS capacitor. Similarly, in the present invention, the boosting capacitor Cb positioned between the first node N1 and the boost line Bn is also formed as a MOS capacitor. Although the boosting capacitor Cb is formed as a MOS capacitor, the boosting capacitor Cb is stably driven.

Figure 4:
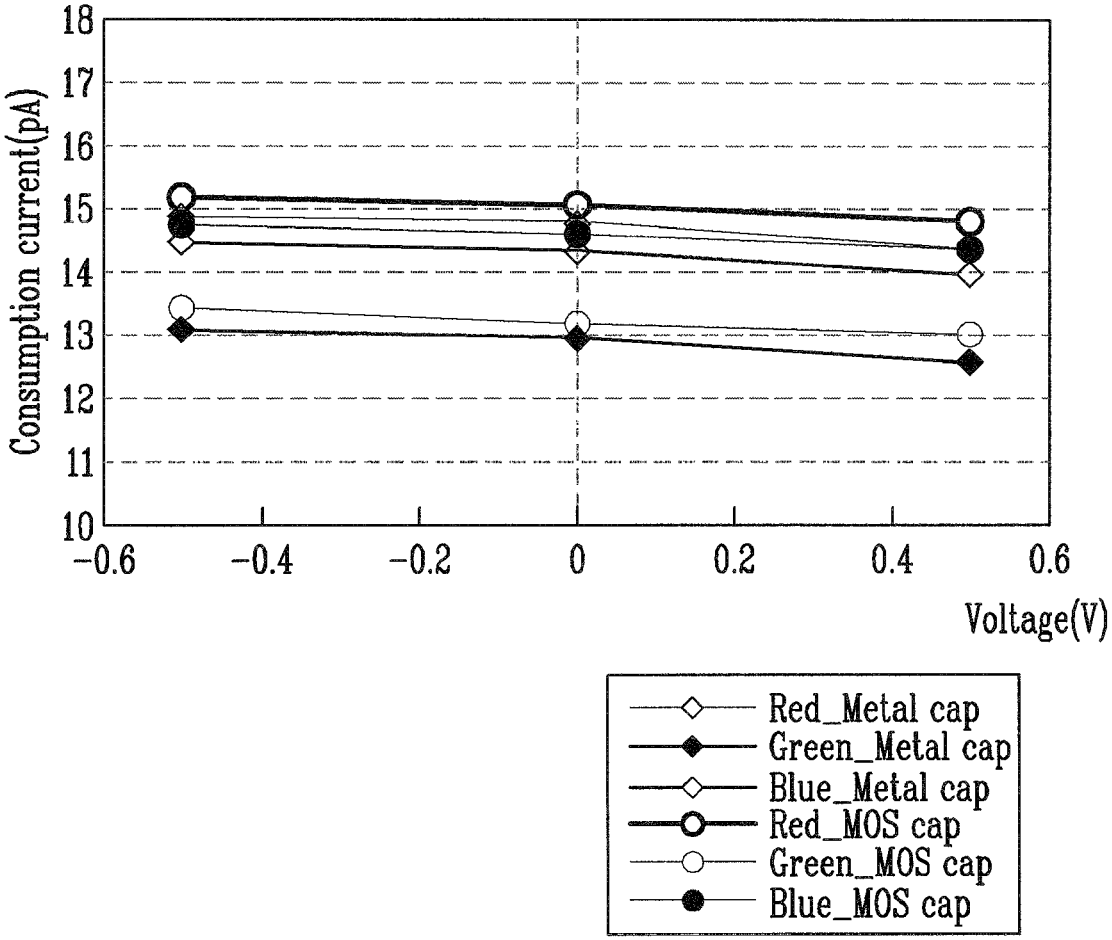
FIG. 4 is a graph showing power consumption corresponding to a change in the threshold voltage of a driving transistor when a capacitor included in a pixel is formed as a MOS capacitor or metal capacitor in expression of a black gray level.

FIG. 4 is a graph showing power consumption corresponding to a change in threshold voltage of a driving transistor when a capacitor included in a pixel is formed as a MOS capacitor or metal capacitor in expression of a black gray level. In FIG. 4, the voltage of the second power source ELVSS is set to be −5.4V, and the voltage of the initialization power source Vint is set to be −2V. The voltage range of the data signal is set to be 1 to 4V.

Referring to FIG. 4, in accordance with the present invention, when a storage capacitor Cst and a boosting capacitor Cb, which included in each red, green and blue pixels, are formed as MOS capacitors, the storage capacitor Cst and the boosting capacitor Cb are stably driven similarly to the metal capacitor.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode between a first power source and a second power source; and a pixel circuit coupled to the organic light emitting diode for controlling an amount of current flowing into the organic light emitting diode, wherein the pixel circuit comprises:

a first transistor for controlling an amount of current flowing from the first power source into the second power source through the organic light emitting diode, the first transistor comprising:

a first electrode coupled to the first power source; and a second electrode coupled to an anode of the organic light emitting diode;

a storage capacitor between a gate electrode of the first transistor and the second power source, the storage capacitor being directly coupled to the second power source; and a boosting capacitor between the gate electrode of the first transistor and a boost line.

2. A pixel comprising:

an organic light emitting diode between a first power source and a second power source; and a pixel circuit coupled to the organic light emitting diode for controlling an amount of current flowing into the organic light emitting diode, wherein the pixel circuit comprises:

a first transistor for controlling an amount of current flowing from the first power source into the second power source through the organic light emitting diode;

a storage capacitor between a gate electrode of the first transistor and the second power source;

a boosting capacitor between the gate electrode of the first transistor and a boost line;

a second transistor coupled to a data line and a scan line, the second transistor being turned on for supplying a data signal supplied from the data line to a first electrode of the first transistor when a scan signal is supplied to the scan line;

a third transistor between the gate electrode of the first transistor and a second electrode of the first transistor, the third transistor being turned on when the scan signal is supplied to the scan line;

a fourth transistor between the first power source and the first electrode of the first transistor, the fourth transistor being turned on or off in response to a light emitting control signal supplied to a light emitting control line; and a fifth transistor between the second electrode of the first transistor and the organic light emitting diode, the fifth transistor being turned on or off in response to a light emitting control signal supplied to the light emitting control line.

3. The pixel as claimed in claim 2, further comprising a sixth transistor between an initialization power source and the gate electrode of the first transistor, the sixth transistor being turned on when the scan signal is supplied to a preceding scan line.

4. The pixel as claimed in claim 3, wherein the initialization power source is set to have a voltage lower than the data signal.

5. The pixel as claimed in claim 3, wherein the initialization power source is set to have a voltage of a negative polarity.

6. An organic light emitting display device, comprising:

a scan driver for sequentially supplying a scan signal to scan lines and for sequentially supplying a light emitting control signal to light emitting control lines;

a boost driver for sequentially supplying a boost signal to boost lines;

a data driver for supplying a data signal to data lines; and pixels for emitting light in response to the data signal, wherein each of the pixels in a horizontal line, comprises:

an organic light emitting diode;

a first transistor for controlling an amount of current that flows from a first power source into a second power source through the organic light emitting diode, the first transistor comprising:

a first electrode coupled to the first power source; and a second electrode coupled to an anode of the organic light emitting diode;

a storage capacitor between a gate electrode of the first transistor and the second power source, the storage capacitor being directly coupled to the second power source; and a boosting capacitor between the gate electrode of the first transistor and a boost line of the boost lines.

7. An organic light emitting display device, comprising:

a scan driver for sequentially supplying a scan signal to scan lines and for sequentially supplying a light emitting control signal to light emitting control lines;

a boost driver for sequentially supplying a boost signal to boost lines;

a data driver for supplying a data signal to data lines; and pixels for emitting light in response to the data signal, wherein each of the pixels in a horizontal line, comprises:

an organic light emitting diode;

a first transistor for controlling an amount of current that flows from a first power source into a second power source through the organic light emitting diode;

a storage capacitor between a gate electrode of the first transistor and the second power source; and a boosting capacitor between the gate electrode of the first transistor and a boost line of the boost lines;

a second transistor coupled to a data line of the data lines and a scan line of the scan lines, the second transistor being turned on for supplying the data signal supplied from the data line to a first electrode of the first transistor when the scan signal is supplied to the scan line;

a third transistor between the gate electrode of the first transistor and a second electrode of the first transistor, the third transistor being turned on when the scan signal is supplied to the scan line;

a fourth transistor between the first power source and the first electrode of the first transistor, the fourth transistor being turned on or off in response to the light emitting control signal supplied to a light emitting control line of the light emitting control lines; and a fifth transistor between the second electrode of the first transistor and the organic light emitting diode, the fifth transistor being turned on or off in response to the light emitting control signal supplied to the light emitting control line.

8. The organic light emitting display device as claimed in claim 6, wherein the scan driver supplies the light emitting control signal to a light emitting control line of the light emitting control lines such that the scan signal supplied to a preceding scan line of the scan lines is overlapped with the scan signal supplied to a scan line of the scan lines.

9. The organic light emitting display device as claimed in claim 8, wherein the boost driver simultaneously supplies the boost signal with the scan signal supplied to the scan line, and suspends the supply of the boost signal after the supply of the light emitting control signal to the light emitting control line is suspended.

10. An organic light emitting display device, comprising:

a scan driver for sequentially supplying a scan signal to scan lines and for sequentially supplying a light emitting control signal to light emitting control lines;

a boost driver for sequentially supplying a boost signal to boost lines;

a data driver for supplying a data signal to data lines; and pixels for emitting light in response to the data signal, wherein each of the pixels in a horizontal line, comprises:

an organic light emitting diode;

a first transistor for controlling an amount of current that flows from a first power source into a second power source through the organic light emitting diode;

a storage capacitor between a gate electrode of the first transistor and the second power source; and a boosting capacitor between the gate electrode of the first transistor and a boost line of the boost lines, the scan driver supplies the light emitting control signal to a light emitting control line of the light emitting control lines such that the scan signal supplied to a preceding scan line of the scan lines is overlapped with the scan signal supplied to a scan line of the scan lines, the boost driver simultaneously supplies the boost signal with the scan signal supplied to the scan line, and suspends the supply of the boost signal after the supply of the light emitting control signal to the light emitting control line is suspended, and a voltage of the boost line falls from a second voltage to a first voltage when the boost signal is supplied.

11. The organic light emitting display device as claimed in claim 10, wherein a difference between the first voltage and the second voltage is set to compensate for voltage loss of the data signal due to charge sharing between a parasitic capacitor of a data line of the data lines and the storage capacitor.

12. The organic light emitting display device as claimed in claim 6, wherein one sides of the storage capacitor and the boosting capacitor are formed of polysilicon.

13. The organic light emitting display device as claimed in claim 7, further comprising a sixth transistor between an initialization power source and the gate electrode of the first transistor, the sixth transistor being turned on when the scan signal is supplied to a preceding scan line of the scan lines.

14. The organic light emitting display device as claimed in claim 13, wherein the initialization power source is set to have a voltage lower than the data signal.

15. The organic light emitting display device as claimed in claim 13, wherein the initialization power source is set to have a voltage of a negative polarity.

* * * * *